United States Patent [19]

Katayama et al.

[11] Patent Number: 4,756,665

[45] Date of Patent: Jul. 12, 1988

[54] CENTRIFUGAL COMPRESSOR

[75] Inventors: Kazuzo Katayama; Taku Ichiryu; Tsuneyoshi Mitsuhashi; Masanori Kobayashi; Yasushi Mori, all of Takasago, Japan

[73] Assignee: Mitsubishi Jukogyo Kabushiki Kaisha, Tokyo, Japan

[21] Appl. No.: 93,141

[22] Filed: Sep. 2, 1987

Related U.S. Application Data

[63] Continuation of Ser. No. 838,562, Mar. 11, 1986, abandoned.

[30] Foreign Application Priority Data

Feb. 3, 1986 [JP] Japan ..... 61-13175[U]

[51] Int. Cl.[4] ..... F01D 25/18

[52] U.S. Cl. ..... 415/175; 415/219 C

[58] Field of Search ..... 415/110, 111, 112, 116, 415/169 R, 175, 219 R, 219 C

[56] References Cited

U.S. PATENT DOCUMENTS

| | | | |
|---|---|---|---|
| 1,967,182 | 7/1934 | Allen | 415/175 |
| 2,830,755 | 4/1958 | Anderson | 415/175 |
| 2,889,106 | 6/1959 | Valley | 415/175 |
| 2,921,533 | 1/1960 | Williams | 415/112 |
| 2,940,660 | 6/1960 | Caddell | 415/175 |
| 2,960,938 | 11/1960 | Williams | 415/175 |
| 3,189,264 | 6/1965 | Becker | 415/175 |
| 3,459,430 | 8/1969 | Ball | 415/112 |
| 3,572,976 | 3/1971 | Sato | 415/112 |
| 3,732,029 | 5/1973 | Raymond et al. | 415/112 |
| 3,733,145 | 5/1973 | Kaplansky et al. | 415/112 |
| 4,361,332 | 11/1982 | Logan et al. | 277/3 |

FOREIGN PATENT DOCUMENTS 2627195 12/1977 Fed. Rep. of Germany .

OTHER PUBLICATIONS

Ernst Honold, "Reaktor-Unqalzpumpen", *KBS Technische Berichte* 14, Jun. 11, 1968, pp. 7–9.

*Primary Examiner*—Robert E. Garrett
*Assistant Examiner*—John T. Kwon
*Attorney, Agent, or Firm*—Wenderoth, Lind & Ponack

[57] ABSTRACT

In a centrifugal compressor of the type that has a head chamber in which various auxiliary passageways are provided that is mounted to a main chamber containing an impeller therein, an annular body is mounted to a free end of the head chamber via seal means, passageways which communicate with respective ones of the various auxiliary passageways are provided within the annular body, and external piping communicating with the respective passageways are fixedly secured to an outer circumferential portion of the annular body.

2 Claims, 6 Drawing Sheets

CENTRIFUGAL COMPRESSOR

This application is a continuation of application Ser. No. 838,562, filed Mar. 11, 1986, now abandoned.

BACKGROUND OF THE INVENTION

1. Field of the Invention

The present invention relates to a centrifugal compressor including a main chamber within which an impeller for compressing a gas is provided and a head chamber within which various kinds of auxiliary passageways are provided, the head chamber being mounted to the main chamber.

2. Description of the Prior Art

At first, description will be made of the above-described type of centrifugal compressor of the prior art, with reference to FIGS. 4 and 5. In FIG. 4, reference numeral (1) designates a final stage impeller, numeral (2) designates a delivery port, impellers including the above-mentioned final stage impeller (1) and the above-mentioned delivery port (2) are provided within a main chamber (7), and a gas pressurized by the aforementioned final stage impeller (1) is supplied to the exterior through the delivery port (2). In addition, reference numeral (3) designates a shaft sealing device, numeral (4) designates bearings, numeral (5) designates a head chamber, reference character (A) designates a balance piston chamber, reference character (A1) designates a gas lead-out passageway through which gas within the balance piston chamber (A) passes to the exterior in order to make a pressure within the balance piston chamber (A) balance with a suction pressure of the compressor, reference character (B) designates a leakage gas chamber, reference character (B1) designates a leakage gas passageway through which the leakage gas within the leakage gas chamber (B) passes to the exterior, reference character (C) designates an exhaust oil chamber, reference character (C1) designates a shaft sealing oil discharge passageway through which a shaft sealing oil within the exhaust oil chamber (C) is discharged to the exterior, reference character (D1) designates a passageway through which lead wires for monitoring instruments extend, reference character (E1) designates a shaft sealing oil feed passageway through which shaft sealing oil is fed to the shaft sealing device (3), reference character (E2) designates a shaft sealing oil discharge passageway through which a shaft sealing oil from the shaft sealing device (3) passes to the exterior, reference character (F1) designates a lubricant oil feed passageway for feeding a lubricant oil to the bearings (4), reference character (F2) designates a lubricant oil discharge passageway through which lubricant oil from the bearings (4) passes to the exterior, reference numeral (11) designates a shaft joint, and the above-mentioned shaft sealing device (3), the above-mentioned bearings (4) and the above-mentioned various kinds of auxiliary passageways (A1), (B1), (C1), (D1), (E1), (E2), (F1) and (F2) are provided within the above-described head chamber (5), which is in turn mounted to the above-described main chamber (7) by means of bolts (6). Furthermore, as shown in FIGS. 4 and 5, external piping communicating with the above-mentioned various auxiliary passageways (A1), (B1), (C1), (D1), (E1), (E2), (F1) and (F2), are mounted to an end surface of the above-described head chamber (5) via flanges (8).

FIG. 6 shows another example of the structure in the prior art, in which one end of a piping (9') is welded to an end surface of a head chamber (5), and a flange (10) of an external piping (9) is mounted to a flange (10') provided at the other end of the piping (9').

In the heretofore known centrifugal compressor shown in FIGS. 4 and 5, there are the following shortcomings:

(1) A large number of external piping has to be mounted via the flanges (8) to the end surface of the head chamber (5) having a limited area, hence it is necessary to reduce a pipe diameter of the external pipings, and so, a pressure loss is increased.

(2) Upon assembly and disassembly, it is necessary to attach and detach the flanges (8) with a narrow working space, and so, a workability was very poor. Also, in the case of the centrifugal compressor in the prior art illustrated in FIG. 6, there is a shortcoming in that since the piping (9') is bent, the dimension of the centrifugal compressor in the axial direction must be large, and so, the length in the axial direction of the portion of the shaft joint (11) is elongated.

(3) FIGS. 7(*a*) and 7(*b*) show a compressor train comprising one steam turbine and two centrifugal compressors according to the prior art. During the overhaul and inspection work of the compressor in such a compressor train, it is inevitably required to hang up the main and head chamber assembly and to move the same to another place. In such a movement, while the afore-mentioned various piping are disconnected at the flange (8) and piping (9), such disconnection must be carried out in the narrow space between the chamber assembly and the adjacent chamber assembly, thereby making workability very poor. In addition, since a part of the flanged ends of the piping after disconnection dangles in the air without any support, it is dangerous in many cases, and, as a counter-measure thereto, a flanged joint (2) is added in the vicinity of the bed plate of the external piping. Therefore, the above-mentioned disconnection work further includes the work to disconnect the joint (20) to remove the pipe, all of which takes a considerable amount of time.

SUMMARY OF THE INVENTION

It is therefore one object of the present invention to provide an improved centrifugal compressor, in which a pressure loss in external piping can be reduced, a workability upon assembly and disassembly can be enhanced, and there is no need to elongate the axial direction of the shaft joint portion.

According to one feature of the present invention, there is provided a centrifugal compressor of the type that includes a main chamber within which an impeller for compressing a gas is provided and a head chamber within which various kinds of auxiliary passageways are provided, the head chamber being mounted to the main chamber, in which an annular body is mounted to an end of the head chamber via seal means, passages which communicate with respective ones of the various kinds of auxiliary passageways are provided within the annular body, and external piping communicating with the respective passageways are fixedly secured to an outer circumferential portion of the annular body.

In the centrifugal compressor according to the present invention, since an annular body is mounted to an end of the head chamber via seal means, passages which communicate respectively with the various kinds of auxiliary passageways are provided within the annular body, and external piping communicating with the respective passageways are fixedly secured to an outer circumferential portion of the annular body as described above, a workability upon assembly and disassembly can be enhanced. In addition, since the external piping extend radially outwards from the outer circumferential surface of the annular body, the centrifugal compressor is not required to be relatively long axially, and the axial length of the shaft joint portion is not elongated.

The above-mentioned and other objects, features and advantages of the present invention will become more apparent by reference to the following description of one preferred embodiment of the invention taken in conjunction with the accompanying drawings.

DESCRIPTION OF THE PREFERRED EMBODIMENT

Figure 1:
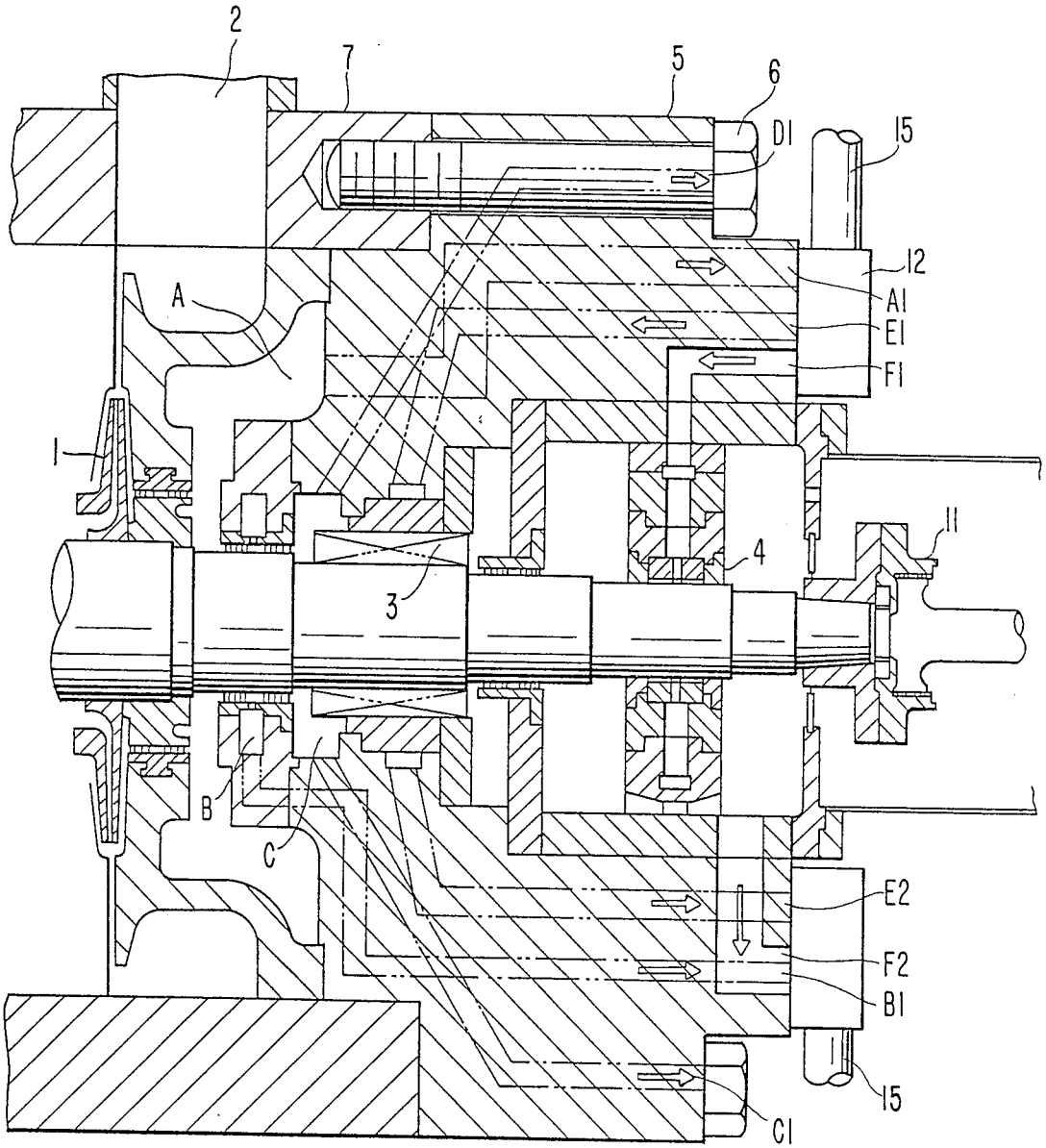
FIG. 1 is a longitudinal cross-sectional side view showing one preferred embodiment of a centrifugal compressor according to the present invention.

Now, the centrifugal compressor according to the present invention will be explained in connection to one preferred embodiment thereof illustrated in FIGS. 1 to 3. In FIG. 1, reference numeral (1) designates a final stage impeller, numeral (2) designates a delivery port, impellers including the above-mentioned final stage impeller (1) and the above-mentioned delivery port (2) are provided within the main chamber (7), and a gas pressurized by the afore-mentioned final stage impeller (1) is supplied to the exterior through the delivery port (2). In addition, reference numeral (3) designates a shaft sealing device, numeral (4) designates bearings, numeral (5) designates a head chamber, reference character (A) designates a balance piston chamber, reference character (A1) designates a gas lead-out passageway through which gas within the balance piston chamber (A) passes to the exterior in order to make a pressure within the balance piston chamber (A) balance with a suction pressure of the compressor, reference character (B) designates a leakage gas chamber, reference character (B1) designates a leakage gas passageway for through which leakage gas within the leakage gas chamber (B) passes to the exterior, reference character (C) designates an exhausts oil chamber, reference character (C1) designates a shaft sealing oil discharge passageway for through which a shaft sealing oil within the exhaust oil chamber (C) passes to the exterior, reference character (D1) designates a passageway through which lead wires for monitoring instruments extend, reference character (E1) designates a shaft sealing oil feed passageway through which shaft sealing oil is fed to the shaft sealing device (3), reference character (E2) designates a shaft sealing oil discharge passageway through which a shaft sealing oil from the shaft sealing device (3) passes to the exterior, reference character (F1) designates a lubricant oil feed passageway through which a lubricant oil is fed to the bearings (4), reference character (F2) designates a lubricant oil discharge passageway through which a lubricant oil from the bearings (4) passes to the exterior, reference numeral (11) designates a shaft joint, and the above-mentioned shaft sealing device (3), the above-mentioned bearings (4) and the above-mentioned various kinds of auxiliary passageways (A1), (B1), (C1), (D1), (E1), (E2), (F1) and (F2) are provided within the above-described header chamber (5), which is in turn mounted to the above-described main chamber (7) by means of bolts (6).

Figure 3:
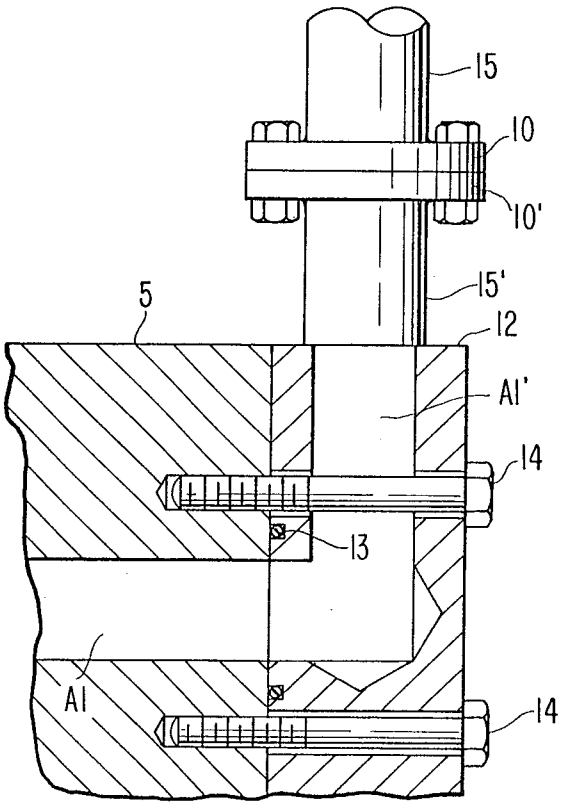
FIG. 3 is a partial longitudinal cross-sectional side view showing an internal structure of an annular body.
Figure 2:
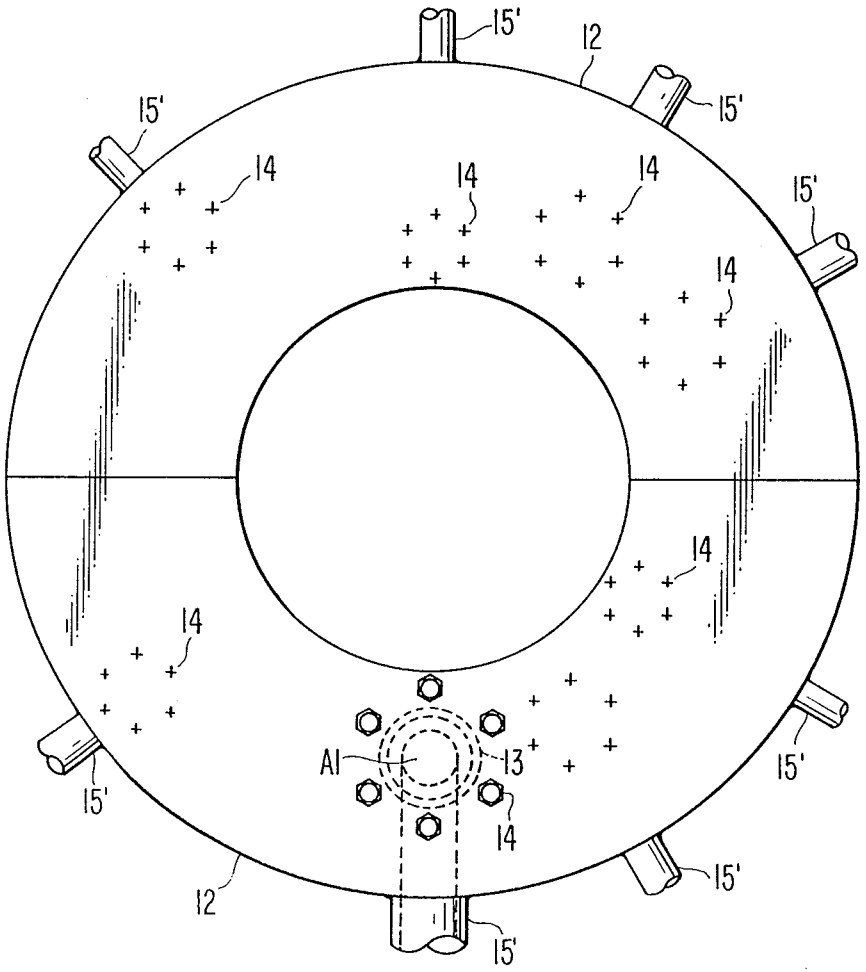
FIG. 2 is an end view of the same.
Figure 4:
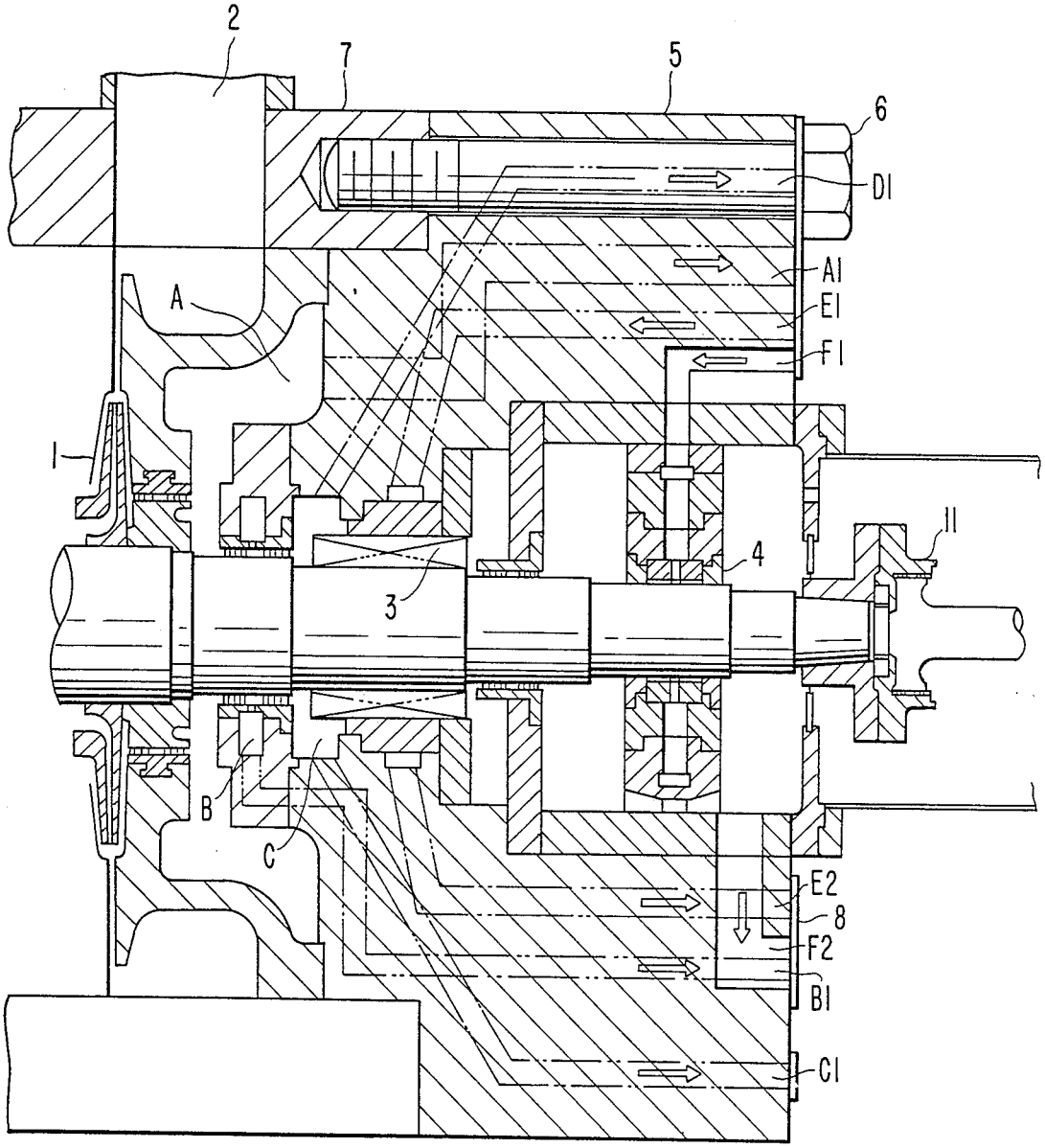
FIG. 4 PRIOR ART
FIG. 4 is a longitudinal cross-sectional side view showing a centrifugal compressor in the prior art.

Furthermore, with reference to FIGS. 1, 2 and 3, reference numeral (12) designates an annular body divided into upper and lower halves, reference numeral (13) designates O-rings (seal means) interposed between the annular body (12) and the head chamber (5), numeral (14) designates a plurality of bolts for fixedly securing the annular body (12) to the head chamber (5), and the gap clearance between the head chamber (5) and the annular body (12) being perfectly sealed by means of these O-rings (13) and the respective bolts (14). Reference character (A1′) designates a passageway communicating with the abovedescribed gas lead-out passageway (A1), this passageway being provided within the annular body (12), and the other end of the passageway (A1′) open at the outer circumferential surface of the annular body (12). Reference numerals (15) and (15′) designate external piping communicating with the passageway (A1′), numerals (10) and (10′) designate flanges for connecting the external piping (15) and (15′) with each other, and one end of the external piping (15′) being welded to the outer circumferential surface of the annular body (12). While the other auxiliary passageways (B1), (C1), (D1), (E1), (E2), (F1) and (F2) also communicate with other external pipings (15′) through passageways similar to the passageway (A1′) likewise provided within the annular body (12), the passageways provided within the annular body (12) other than the passageway (A1′) are omitted from illustration.

Now description will be made as to the operation of the centrifugal compressor shown in FIGS. 1 to 3 in greater detail. A gas pressurized by the final stage impeller (1) is supplied to the exterior through the abovedescribed delivery port (2). Furthermore, in order to make the pressure within the balance piston chamber (A) balance with the suction pressure of the compressor, the gas within the balance piston chamber (A) passes to the exterior through the gas lead-out passageway (A1)→the passageway (A1′) within the annular body (12)→the external piping (15′) and (15). Also, the leakage gas within the leakage gas chamber (B) passes to the exterior through the leakage gas passageway (B1)→the passageway (not shown) within the annular body (12). In addition, the shaft sealing oil within the exhaust oil chamber (C) is discharged to the exterior through the shaft sealing oil discharge passageway (C1)→the passage (not shown) within the annular body (12)→the external piping (15) and (15'). Also, the shaft sealing oil is fed to the shaft sealing device (3) through the external piping (15') and (15)→the passageway (not shown) within the annular body (12)→the shaft sealing oil feed passageway (E1). Further, the shaft sealing oil coming from the shaft sealing device (3) is discharged to the exterior through the shaft sealing oil discharge passageway (E2)→the passage (not shown) within the annular body (12)→the external piping (15') and (15). Also, the lubricant oil is fed to the bearings (3) through the external piping (15') and (15)→the passageway (not shown) within the annular body (12)→the lubricant oil feed passageway (F1). In addition, the lubricant oil coming from the bearings (4) is discharged through the lubricant oil discharge passageway (F2)→the passageway (not shown) within the annular body (12)→the external piping (15') and (15).

In the centrifugal compressor according to the present invention, since an annular body is mounted to an end of a head chamber via seal means, passageways communicating with the respective ones of various kinds of auxiliary passageways are provided within the annular body, and external piping communicating with the respective passageways are fixedly secured to an outer circumferential portion of the annular body as described above, there is no need to reduce the pipe diameters of external piping, and hence a pressure loss in the external piping can be reduced. In addition, since the external piping communicating with the respective passageways within the annular body are fixedly secured to the outer circumferential portion of the annular body as described above, attachment and detachment of the external piping can be done at the outer circumferential portion of the annular body, and hence a workability upon assembly and disassembly can be enhanced. Furthermore, since the external piping extend radially outwards from the outer circumferential surface of the annular body, there is an advantage in that the centrifugal compressor need not be long in the axial direction and hence the axial length of the shaft joint portion is not required to be elongated.

Figure 8A:
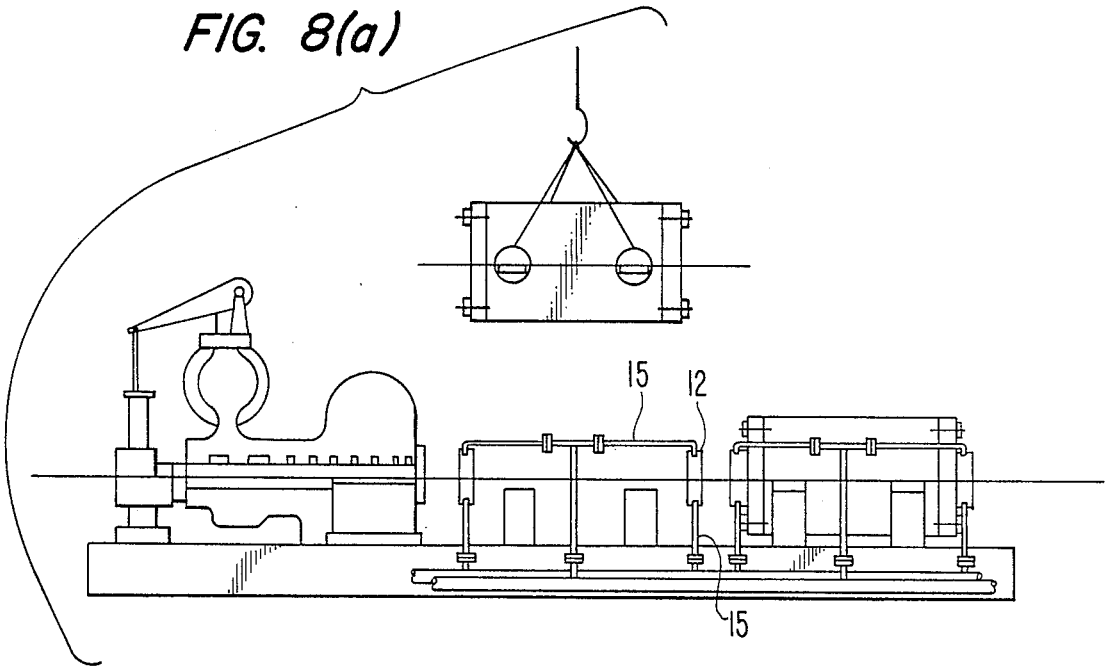
FIGS. 8(*a*) and 8(*b*) are side views respectively of compressor trains comprising a steam turbine and two centrifugal compressors according to the present invention, with FIG. 8(*a*) showing a centrifugal compressor removed from the external piping.
Figure 8B:
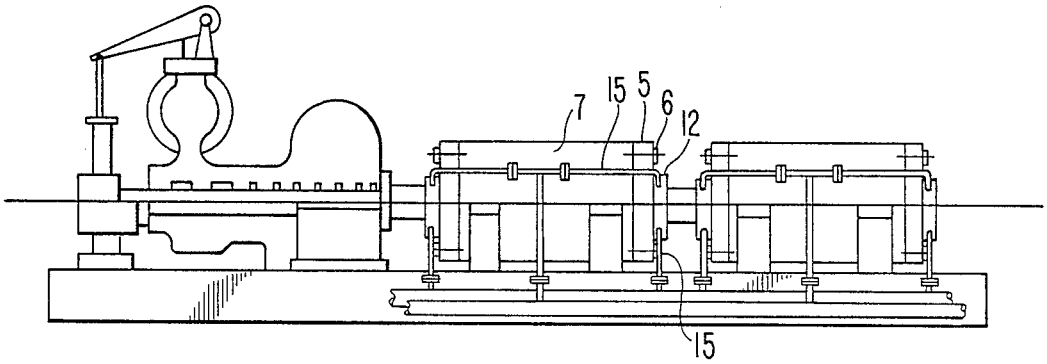
Figure 6:
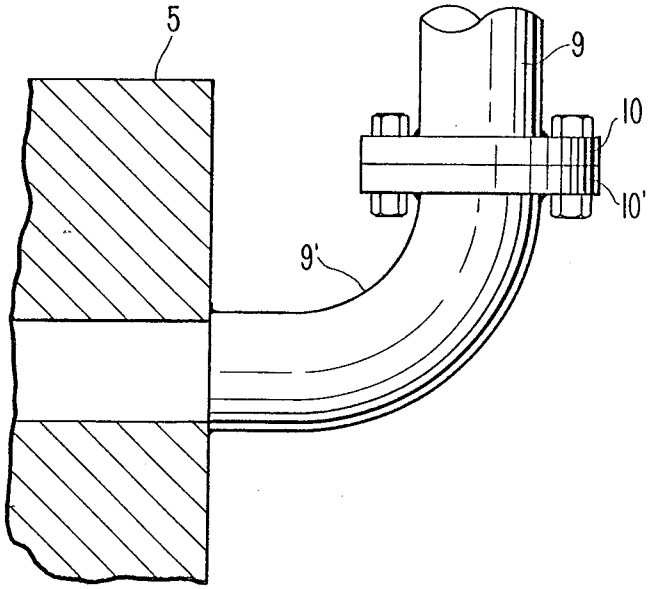
FIG. 6 PRIOR ART
FIG. 6 is a side view showing an external piping portion of another example of a centrifugal compressor in the prior art.
Figure 5:
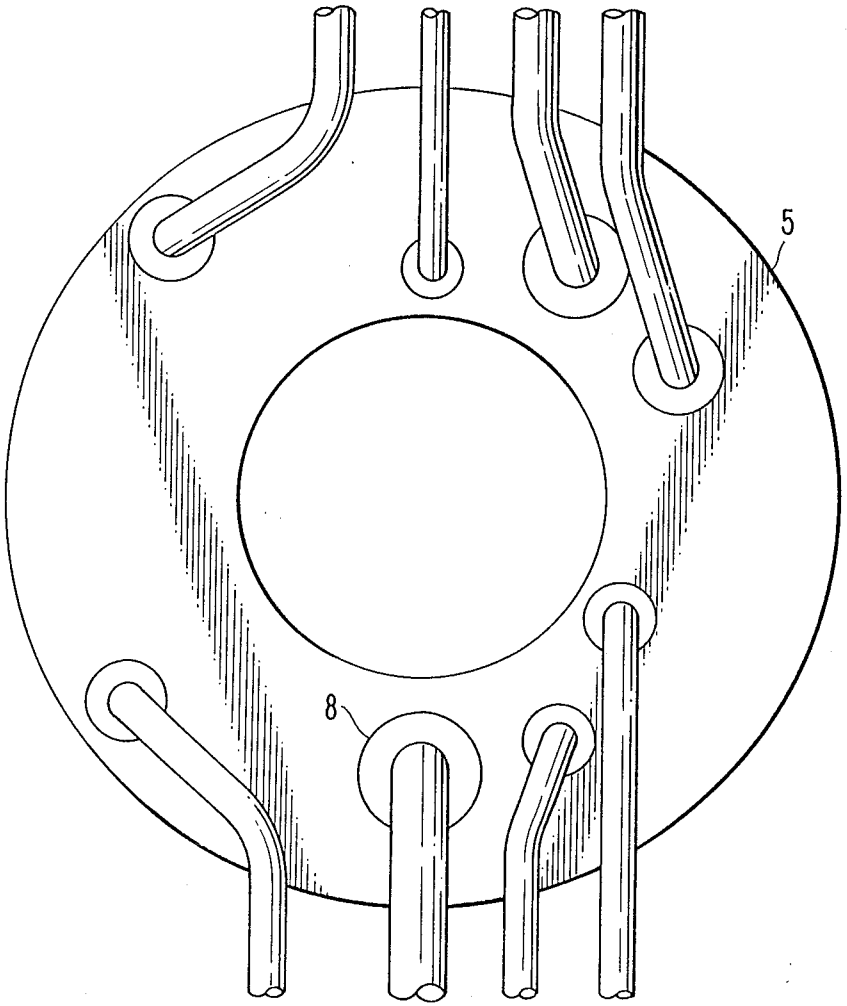
FIG. 5 PRIOR ART
FIG. 5 is an end view of the same.
Figure 7A:
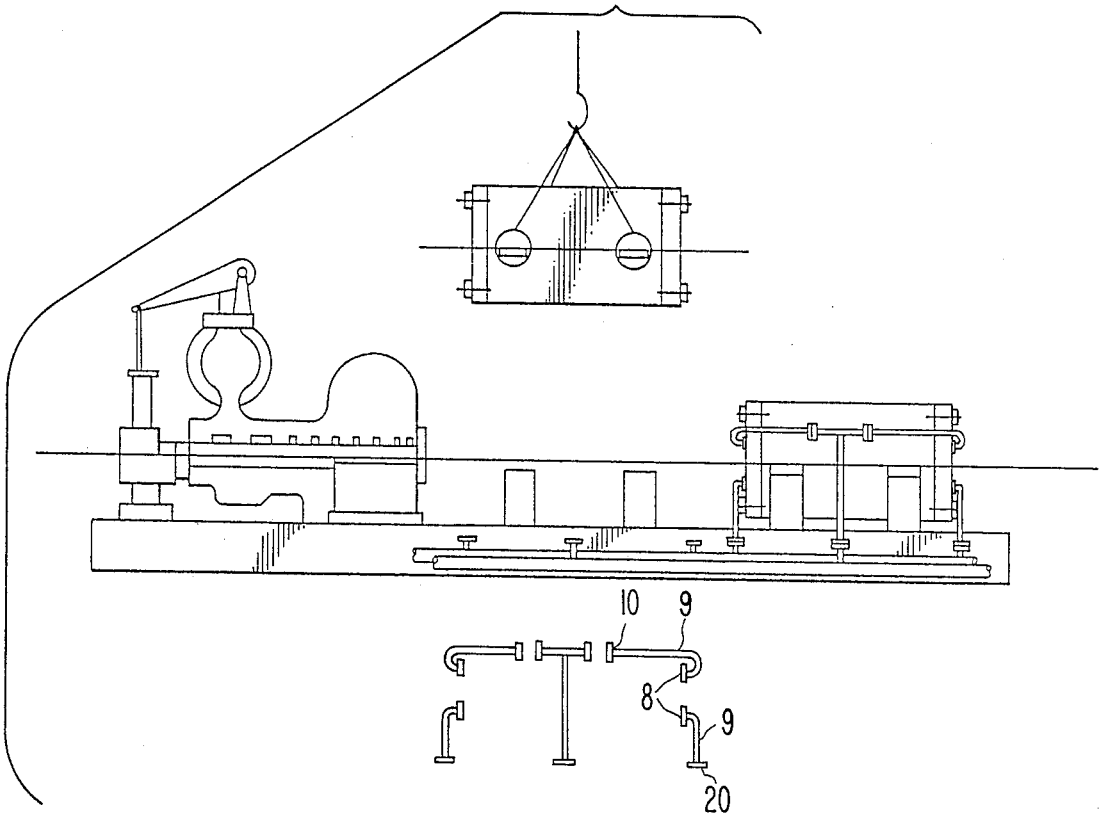
FIGS. 7(*a*) and 7(*b*) are side views respectively of compressor trains comprising a steam turbine and two centrifugal compressors of the prior art, with FIG. 7(*a*) showing a state of disassembly of the compressor train.
Figure 7B:
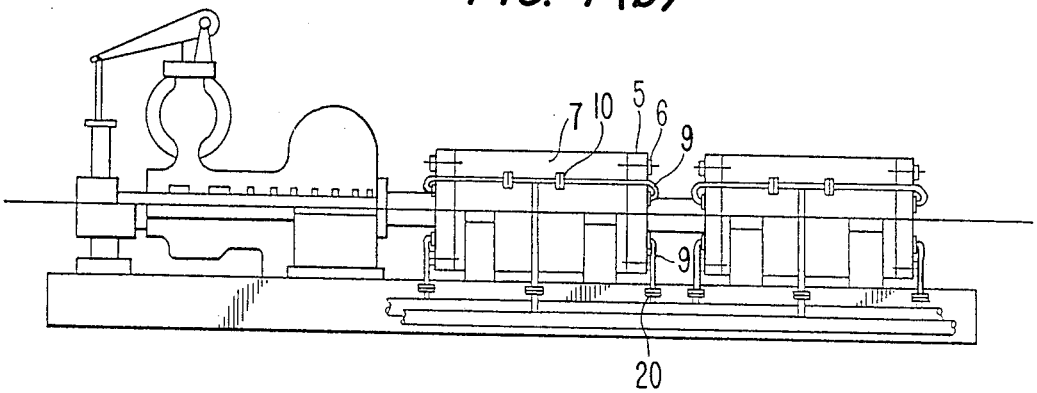

Furthermore, with reference to FIGS. 8(*a*) and 8(*b*), which show a compressor train corresponding to FIGS. 7(*a*) and 7(*b*) but including the contrivance according to the present invention, the various external piping can be separated from the main and head chamber assembly only by disconnecting the fastening bolts (14), leaving the piping (15) and the annular body (12) at their original positions, thereby enabling the work time to be considerably shortened. The fact that the piping does not extend in the axial direction, together with the fact that attachment and detachment of the fastening bolt (14) can be easily carried out, brings a remarkable improvement of workability.

Since many changes and modifications can be made to the above-described construction without departing from the spirit of the present invention, it is intended that all matter contained in the above-description and illustrated in the accompanying drawings shall be interpreted to be illustrative and not as a limitation to the scope of the invention.

What is claimed is:

1. A centrifugal compressor comprising:

a main chamber having an impeller therein for compressing gas;

a head chamber mounted at one end thereof to said main chamber, said head chamber having a plurality of auxiliary passageways extending therein to the other end thereof opposite from said end which is mounted to said main chamber;

an annular body detachably mounted at a mounting position to said other end of said head chamber by fastening means, said annular body having a plurality of passageways extending therethrough each of which is open to at one end thereof and communicates with a respective one of said plurality of passageways of said head chamber; and external piping fixed to said annular body and open to and communicating with said passageways of said annular body at other ends thereof respectively, said annular body and said external piping fixed thereto comprising an integral independent structure such that when only said fastening means are unfastened, said main chamber and said head chamber are separable from said integral structure, and when said main chamber and said head chamber are separated from said integral structure, said structure remains independent and integral with said annular body remaining at said mounting position.

2. A centrifugal compressor as claimed in claim 1, wherein said head chamber is mounted to said main chamber at one end thereof; and further comprising a second head chamber mounted at one end thereof to the other end of said main chamber, a second annular body detachably mounted to the other end of said second head chamber, and external piping fixed to said second annular body, said integral independent structure also comprising said second annular chamber and said external piping fixed thereto.

* * * * *